United States Patent [19]

Schmitt et al.

[11] Patent Number: 5,062,577

[45] Date of Patent: Nov. 5, 1991

[54] AGITATOR MILL

[75] Inventors: Philipp Schmitt, Lampertheim; Norbert Stehr, Grünstadt, both of Fed. Rep. of Germany

[73] Assignee: Draiswerke GmbH, Mannheim, Fed. Rep. of Germany

[21] Appl. No.: 439,048

[22] PCT Filed: May 10, 1988

[86] PCT No.: PCT/EP88/00408

§ 371 Date: Nov. 6, 1989

§ 102(e) Date: Nov. 6, 1989

[87] PCT Pub. No.: WO88/09212

PCT Pub. Date: Dec. 1, 1988

[30] Foreign Application Priority Data

May 18, 1987 [DE] Fed. Rep. of Germany ..... 3716587

[51] Int. Cl.[5] ..... B02C 17/16

[52] U.S. Cl. ..... 241/171; 241/172

[58] Field of Search ..... 241/172, 171, 170, 179, 241/180, 69

[56] References Cited

U.S. PATENT DOCUMENTS 4,629,133 12/1986 Buhler ..... 241/172 X
4,742,966 5/1988 Szkaradek et al. ..... 241/172 X

FOREIGN PATENT DOCUMENTS 58886 2/1982 European Pat. Off. .
146852 12/1984 European Pat. Off. .
2811899 12/1984 Fed. Rep. of Germany .
470204 5/1969 Switzerland .

*Primary Examiner*—Mark Rosenbaum
*Attorney, Agent, or Firm*—Browdy and Neimark

[57] ABSTRACT

An agitator mill for the treatment of flowable grinding stock has a grinding receptacle (3) with a mostly closed grinding chamber (9) and a rotatingly drivable agitator element (21) disposed therein. An interior stator (24) is disposed in the agitator element. A grinding stock supply chamber (53) is placed ahead of the grinding chamber. On the same side of the grinding receptacle (3) a separator device (34) is provided through which the grinding stock is discharged again after treatment. In order to prevent to a large extent wear on the separator device (34) and, at the same time, to achieve as even as possible a distribution of the grinding bodies in the grinding chamber (9), the agitator element (21) is designed approximately cup-shaped and disposed between the interior stator (24) and the wall of the grinding receptacle (3) with the formation of an exterior grinding chamber (9') and an interior grinding chamber (9''). The grinding stock supply chamber (53) is placed ahead of the exterior grinding chamber (9') and the separator device (34) is placed behind the interior grinding chamber (9''). The interior grinding chamber (9'') is connected by bypasses (60), placed ahead of the separator device (34), with the exterior grinding chamber (9') for the purpose of returning the auxiliary grinding bodies (41).

12 Claims, 5 Drawing Sheets

AGITATOR MILL

TECHNICAL FIELD

Figure 1:
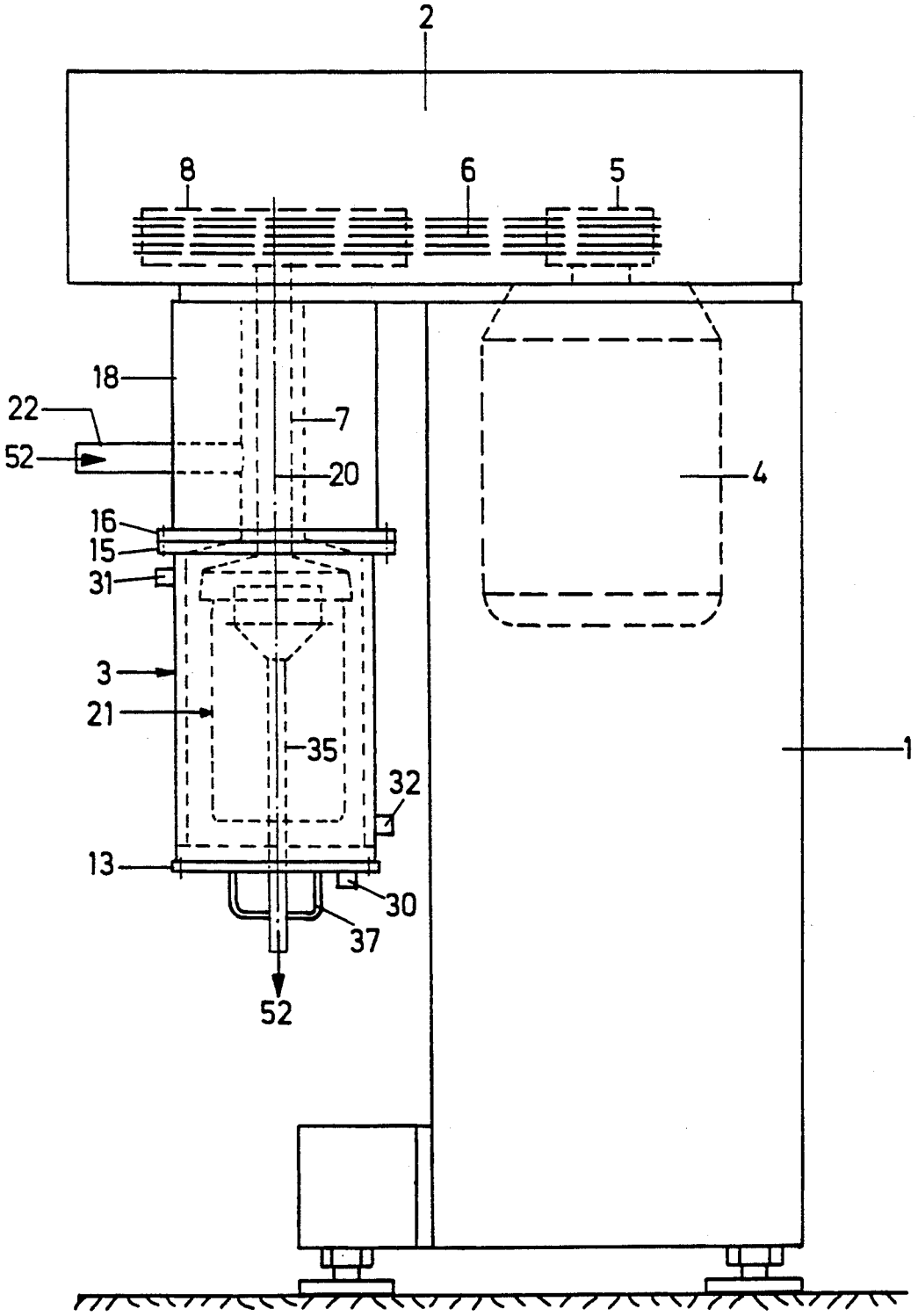

The invention relates to an agitator mill for the treatment of flowable grinding stock with a grinding receptacle defining a mostly closed grinding chamber and with an agitator element, capable of being rotatingly driven and being cup-shaped in relation to a common center-longitudinal axis, disposed therein, inside of which is disposed an interior stator fixedly connected with the grinding receptacle, an exterior grinding chamber being formed between the grinding receptacle and an outer wall of the agitator element and an interior grinding chamber being formed between an interior wall of the agitator element and the interior stator, which is disposed coaxially within the exterior grinding chamber and is connected with it via a deflection chamber, the exterior grinding chamber, the deflection chamber and the interior grinding chamber forming the grinding chamber partially filled with auxiliary grinding bodies, a grinding stock supply chamber, disposed ahead of the grinding chamber in relation to the flow direction of the grinding stock, and a separator device for the discharge of the grinding stock, disposed after the grinding chamber in relation to the flow direction of the grinding stock, are disposed on the same side of the grinding receptacle, and with bypasses for the return of the auxiliary grinding stock from the area of the separator device to the area of the grinding stock supply chamber being provided in the agitator element.

STATE OF THE ART

In such an agitator mill, known from German Patent No. 28 11 899, the exterior grinding chamber on the one side and the interior grinding chamber each taper in the form of a truncated cone, i.e. the diameter of the grinding chamber is conical on each side of the center-longitudinal axis. The same is true for the diameter of the agitator element. The grinding stock flows through the agitator mill from the inside out, i.e. it flows into the interior grinding chamber at the narrow diameter, flows through the radially widening interior grinding chamber, the deflection chamber and then the radially widening exterior grinding chamber. From there it flows radially inward through a chamber, limited on one side by the agitator element, to a separator device through which the grinding stock is discharged. The entrance of a bypass is located behind this separator device, the entrance of which is disposed radially within the separator device, i.e. is disposed behind it. From there the auxiliary grinding bodies flow into the beginning area of the interior grinding chamber via bypasses in the rotor.

An agitator mill is known from European Patent No. 0 146 852 having a grinding chamber with a cylindrical inner wall and a cylindrical rotor, an annular cylindrical grinding chamber being formed between the rotor and the inner wall of the grinding receptacle. The agitator element has a hollow chamber on its free end into which a separator device extends. In this area the agitator element is provided with recesses around the separator device which permit the auxiliary grinding bodies, which freely flow into the hollow chamber together with the grinding stock, to exit radially.

An agitator mill is known from German Published, Nonexamined Application No. DE-OS 31 06 062 (corresponding to U.S. Pat. No. 4,496,106), in which an annular cylindrical grinding chamber is formed between a cylindrical inner wall of a grinding receptacle and a cylindrical rotor. Grinding stock is supplied to the grinding chamber from below. It is removed at the top through a separator device. A bypass is formed ahead of the separator device in the grinding receptacle into which the auxiliary grinding bodies are catapulted before reaching the separator device. They are again returned to the grinding stock prior to entry into the grinding chamber.

DESCRIPTION OF THE INVENTION

It is an object of the invention to improve an agitator mill of the species in such a way that it is possible to obtain a return of the auxiliary grinding bodies which prevents to the greatest extent possible wear of the separating device while, at the same time, distributing the auxiliary grinding bodies as evenly as possible in the grinding chamber.

This object is achieved in accordance with the invention in that the exterior grinding chamber and the interior grinding chamber are in general in the form of annular cylinders, in that the grinding stock supply chamber is placed ahead of the exterior grinding chamber in relation to the flow direction of the grinding stock, and in that the separator device is placed after the interior grinding chamber in relation to the flow direction of the grinding stock, and in that the bypasses are placed ahead of the separator device in relation to the flow direction of the grinding stock. Because of the cylindrical form of the interior grinding chamber and the exterior grinding chamber it is achieved that the grinding stock and in particular the auxiliary grinding bodies only need to travel small radial distances on their way through the grinding receptacle. Because of the outward to inward direction of flow through the grinding chamber it is achieved that the return of the auxiliary grinding bodies takes place from the inside towards the outside, i.e. by utilizing the centrifugal forces occurring. Because at the same time the auxiliary grinding bodies are catapulted off before the stream consisting of grinding stock and auxiliary grinding bodies reaches the separator device, the latter is free of auxiliary grinding bodies to the greatest extent possible and thus is not subject to any noticeable wear. Since the separator device is free of auxiliary grinding bodies to a large extent, there is the possibility of using extremely narrow gap widths. For example, for the minimally possible diameter of 0.2 mm for auxiliary grinding bodies it is possible to use gap widths up to 0.5 mm without the danger of blocking the separator device, because accumulation of auxiliary grinding bodies in front of the separator device is not possible. Because of the return of the auxiliary grinding bodies into an area of the grinding chamber free of auxiliary grinding bodies to a large extent, an uneven concentration of auxiliary grinding bodies in the grinding chamber or, in the worst case an accumulation of auxiliary grinding bodies, is being already made impossible from the start. It ensues from the above that the separator device and the grinding stock supply chamber are disposed approximately in a cross sectional plane of the grinding receptacle, i.e. both are in its upper region in case of a vertical arrangement of the grinding receptacle or, in a horizontal arrangement, on one side.

If, in an advantageous improvement, the separator device is disposed at a front face of the interior stator and is at least partially surrounded by the agitator element with the formation of an annular cylindrical antechamber, it is additionally prevented that auxiliary grinding bodies reach the separator device.

If, in the course of using particularly viscous grinding stocks, such as for instance chocolate, grinding bodies could accumulate in the area of the separator device, the bypasses are opened in an advantageous manner also in the direction of the transition. This results in a forced return of the auxiliary grinding bodies ahead of the separator device and therefore not merely the centrifugal acceleration resulting from their movement is used.

Maximum outward acceleration of the auxiliary grinding bodies in the bypasses is achieved if the bypasses are in general disposed in a plane which is vertical to the central longitudinal axis or if the bypasses extend inclined against the rotational direction of the agitator element as seen from the central longitudinal axis. A particularly simple feeding of the auxiliary grinding bodies from the bypasses into the area free of auxiliary grinding bodies at the beginning of the exterior grinding chamber is positively affected by the bypasses opening approximately parallel to the direction of flow of the grinding stock into the transition area between the grinding stock supply chamber and the exterior grinding chamber.

A particularly simple cleaning of the separator device is made possible by making the diameter of the separator section smaller than the interior diameter of the interior stator and by the separator device being designed so it can be pulled through the interior stator out of it. In order to prevent, in particular in the vertical arrangement of the agitator mill, an accumulation of auxiliary grinding bodies in the deflection chamber during start-up of the agitator mill, in an advantageous improvement transport devices for the auxiliary grinding bodies are provided at the beginning of the interior grinding chamber. The agitator mill may be arranged and operated equally well with a horizontal center longitudinal axis, a vertical center longitudinal axis or with an axis inclined between these two arrangements.

Basically the agitator mill may be operated without separate agitator implements on the agitator element or on the correspondingly associated surfaces on the interior stator or the grinding receptacle. However, it is of advantage if agitator implements extending into the grinding chamber are at least disposed on the agitator element. It may be particularly practical not to dispose agitator implements on the interior stator in the area ahead of the bypasses so as to prevent slowing of the auxiliary grinding bodies in this area.

Although the separator device is not used to an appreciable degree for the separation of auxiliary grinding bodies on the one hand and grinding stock on the other, the term separator device is being used because it has been generally used in the language of the relevant art. As follows from the above, separation of the auxiliary grinding bodies from the grinding stock per se already takes place ahead of the separator device.

SHORT DESCRIPTION OF THE DRAWINGS

Details of the invention ensue from the following description of exemplary embodiments of the invention. Shown are in FIG. 1 a schematic view of an agitator mill in a lateral view, FIG. 2 a longitudinal section through the grinding receptacle of an agitator mill, FIG. 3 a partial section of FIG. 2 in enlargement, FIG. 4 a partial cross section of the agitator element of the agitator mill along the line IV—IV of FIG. 2 and FIG. 3, and FIG. 5 a partial section from a changed embodiment of an agitator mill.

BEST WAYS TO EXECUTE THE INVENTION

In the customary way the agitator mill shown in FIG. 1 has a stand 1, on the upper surface of which a projecting support arm 2 is disposed on which in turn a cylindrical grinding receptacle 3 is fastened. An electrical drive motor 4 is housed in the stand 1 and is provided with a V-belt pulley 5 by means of which a V-belt pulley 8, fixed against rotation on a shaft 7, is driveable via V-belts 6.

Figure 2:
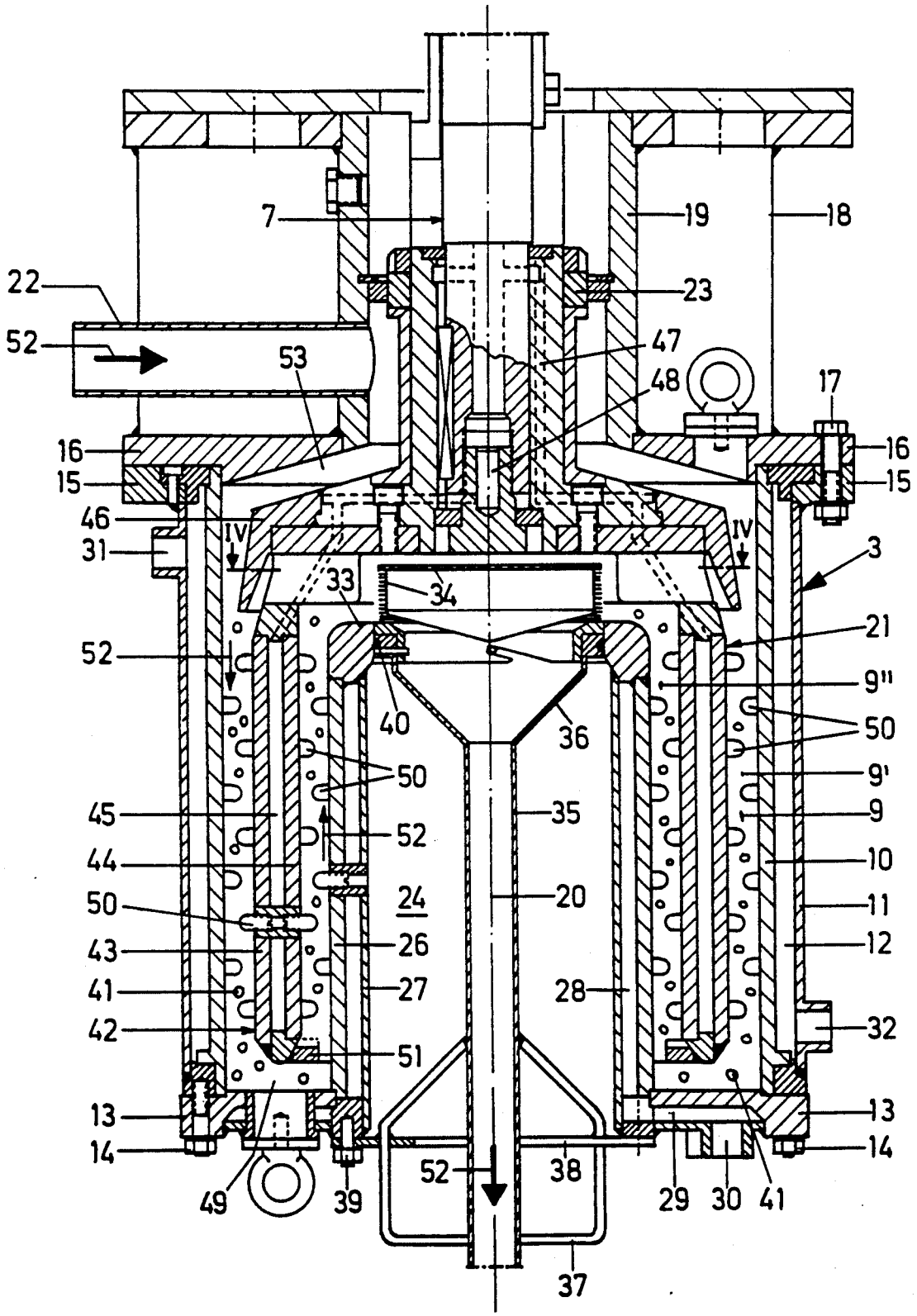

As shown in particular in FIG. 2, the grinding receptacle 3 comprises a cylindrical interior cylinder 10 surrounding a grinding chamber 9 and surrounded by a generally cylindrical outer casing 11. The interior cylinder 10 and the outer casing 11 define between each other a cooling chamber 12. The lower closure of the grinding chamber 9 is formed by a circular bottom plate 13 which is fastened by means of screws 14 to the grinding receptacle.

The grinding receptacle 3 has an upper annular flange 15 by means of which it is fixed with screws 17 on a lid 16 which closes the grinding chamber 9. This lid 16 is fastened to the underside of a support housing 18 which is fixed with its upper end on the support arm 2 of the agitator mill. The support housing 18 has a central cylindrical section 19 disposed coaxially with the central-longitudial axis 20 of the grinding receptacle 3. This section 19 is penetrated by the shaft 7, also extending coaxially with the axis 20, on which is provided in the grinding chamber 9 a rotor used as an agitator element 21. A grinding stock supply line 22 opens into the area of the central cylindrical section 19 of the support housing 18 adjacent to the grinding chamber 9. Above the opening of this supply line 22, i.e. between this supply line 22 and the support arm 2, a seal 23 is provided between the agitator element 21 and the section 19, which prevents the upwardly escape of grinding stock in the direction of the support arm 2.

On the circular bottom plate 13 is fixed an approximately cup-shaped, cylindrical interior stator 24, extending into the grinding chamber 9, comprising an outer casing 26, cylindrical and coaxial with the axis 20 and defining the grinding chamber 9, and a cylindrical inner casing 27, also coaxial with the axis 20. Between themselves the outer casing 26 and the inner casing 27 define a cooling chamber 28. The cooling chamber 28 is connected with a cooling chamber 29 in the bottom plate 13, to which cooling water is supplied via a cooling water supply connector 30, and which is removed via a discharge connector, not shown. Cooling water is supplied to the cooling chamber 12 of the grinding receptacle 3 via a cooling water supply connector 31 and is removed via a cooling water discharge connector 32.

A grinding stock/auxiliary grinding body separator device 34 connected with a grinding stock discharge line 35 is disposed on the upper face 33, located in the grinding chamber, of the interior stator 24. A grinding stock collection funnel 36 is provided between the separator device 34 and the discharge line 35. The discharge line 35 is provided with a handle 37 in the area of the bottom plate 13 which, in turn, is provided with a fastening ring 38 removably attached by means of screws 39 on the bottom plate 13 or on the interior stator 24 and fixedly connected with it. The separtor device is sealed against the annular face 33 of the interior stator 24 by a seal 40 and may be, after loosening of the screws 39, pulled downwardly out of the interior stator 24, together with the discharge line 35 and the collection funnel 36, by means of the handle 37. Thus the separator device 34 can be pulled out of the grinding chamber 9 without the requirement of having to remove the auxiliary grinding bodies 41, contained in it, from the grinding chamber, because the level of these auxiliary grinding bodies 41 in the grinding chamber 9 does not extend to the face 33 when the agitator element 21 is not in motion.

In its basic structure the agitator element 21 is cup-shaped, i.e. it has an essentially cylindrical rotor 42 with a cylindrical outer wall 43 and a cylindrical inner wall 44 disposed coaxially thereto and coaxially to the axis 20. A cooling chamber 45 is formed between the outer wall 43 and the inner wall 44 of the rotor 42. The rotor 42 is fixed on a rotor bottom 46 which is connected with the shaft 7. Supply and removal of cooling water to the cooling chamber 45 takes place via cooling water conduits 47, 48 formed in the shaft 7. The grinding chamber 9 is divided on the one side by the interior cylinder 10 of the grinding receptacle 3 and the cylindrical outer wall 43 of the rotor 42 and, on the other side, by the cylindrical inner wall 44 of the rotor 42 and the cylindrical outer casing 26 of the interior stator 24 into a cylindrical ring-shaped exterior grinding chamber 9' and an interior grinding chamber 9", respectively, which are connected with each other by a deflection chamber 49 in the area of the bottom plate 13.

Agitator implements 50, extending in the shape of pegs into the exterior grinding chamber 9' or the interior grinding chamber 9", are disposed on the grinding chamber boundary walls formed by the interior cylinder 10, the outer wall 43, the inner wall 44 and the outer casing 26. At the lower free end of the rotor 42 are disposed transport elements 51, inwardly extending towards the interior stator 24 and equipped with, for example, oblique surfaces, by means of which the grinding stock and the auxiliary grinding bodies 41 are transported into the inner grinding chamber 9" in the direction towards the separator device 34 when the agitator element 21 is correspondingly rotatingly moved upward. The grinding stock flows through the grinding chamber 9 according to the flow direction arrows 52, coming from the grinding stock supply line 22, through a grinding stock supply chamber 53 between the rotor bottom 46 and the lid 16, down the exterior grinding chamber 9', through the deflection chamber 49 radially inwards and from there upwards through the interior grinding chamber 9" up to the separator device 34. When the agitator element 21 is being rotatingly driven, it is ground with the cooperation of the auxiliary grinding bodies 41 on its way through the exterior grinding chamber 9', the deflection chamber 49 and the interior grinding chamber 9". The grinding stock leaves the grinding chamber 9 through the separator device 34, from where it flows off through the grinding stock discharge line 35.

Figure 3:
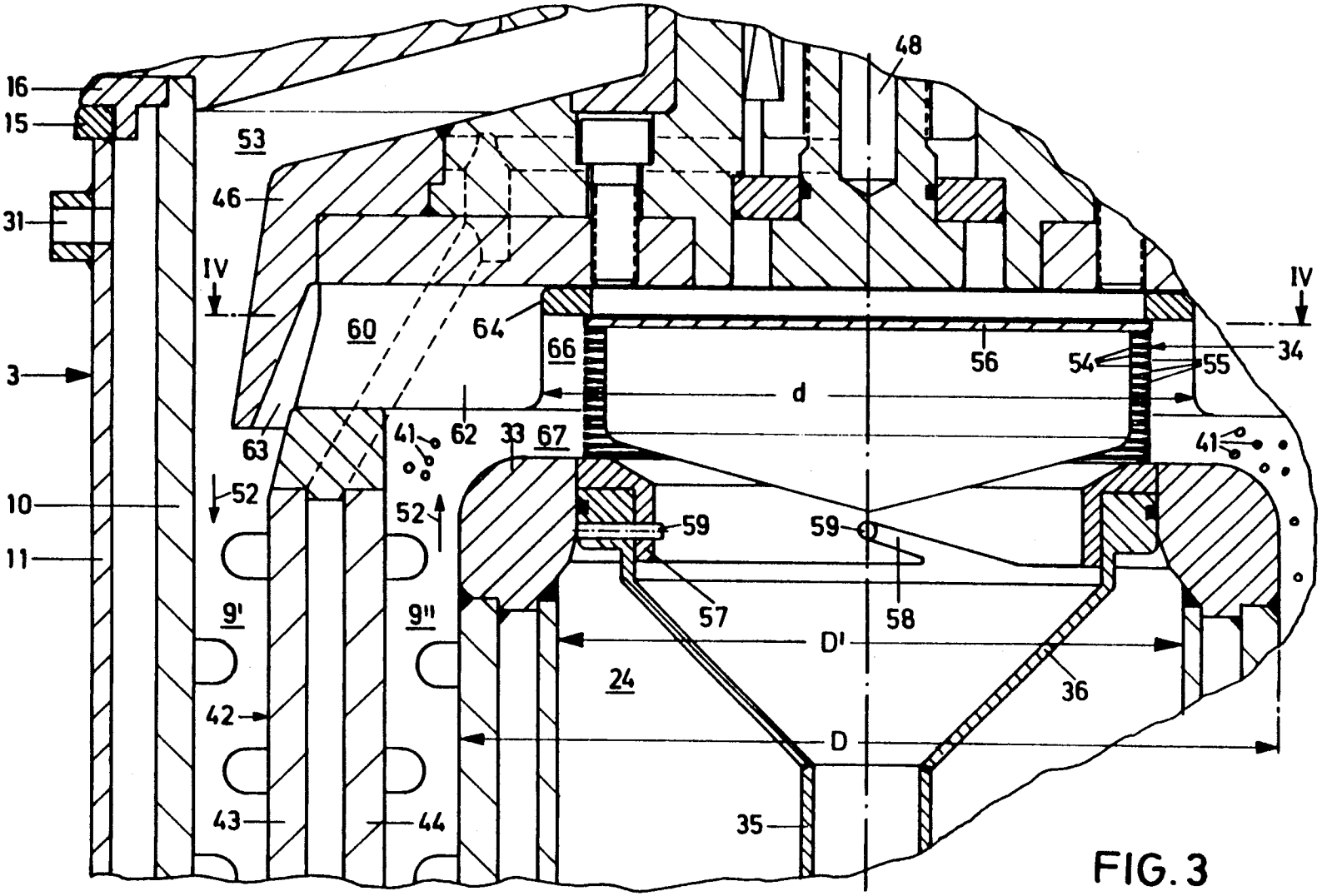

As illustrated in FIG. 3, the separator device 34 comprises a stack of annular disks 54, between each of which a separating gap 55 has been left, the width of which is less than the diameter of the smallest auxiliary grinding body 41 used, as a rule smaller than half the diameter of these smallest used auxiliary grinding bodies 41. This stack of annular disks 54 is closed off at the front by a closing plate 56. A support ring 57 is provided in the direction towards the grinding stock collection funnel 36 and is provided with obliquely disposed slits 58 by means of which it can be fastened in the manner of a slide lock on pegs 59 provided on the interior stator 24. The separator device 34, comprising the support ring 57, the annular disks 54 and the closing plate 56, can be easily removed by a partial turn from the collection funnel 36 with the discharge line 35 after having been pulled out of the interior stator 24, as already described.

Figure 4:
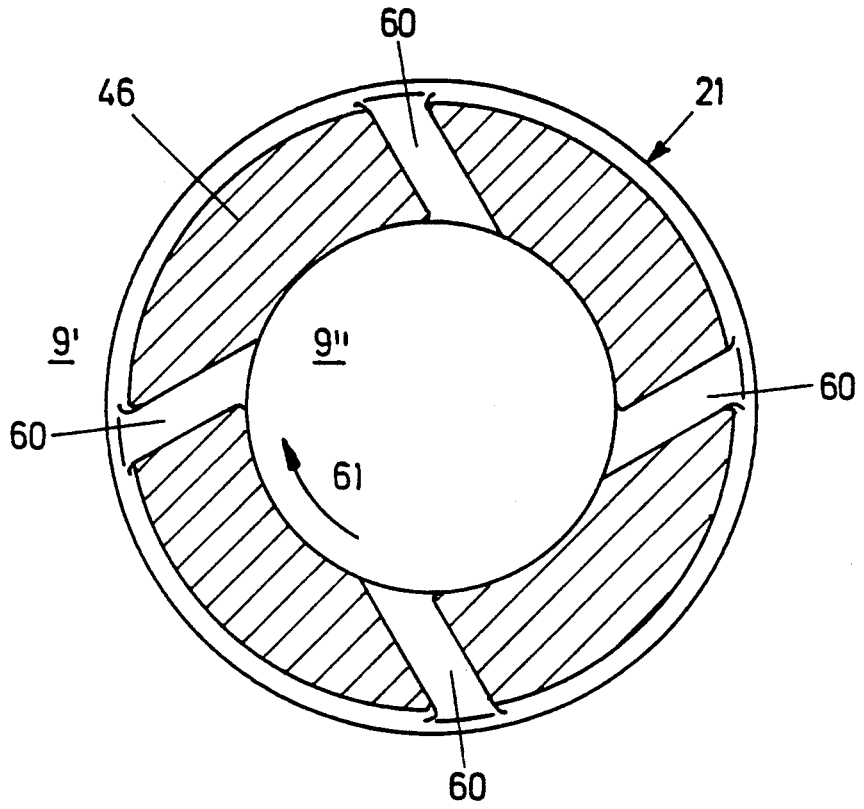

In the transition area between the cylindrical rotor 42 and the rotor bottom 46 and—in front of the separator device 34, looking in the direction of the flow direction arrows 52—bypasses 60 are located in the rotor bottom 46. These connect—in respect to the direction of flow corresponding to the flow direction arrows 52—the end of the interior grinding chamber 9" with the beginning of the exterior grinding chamber 9', thus with the area of the grinding stock supply to the grinding chamber 9. As shown in FIG. 4, these bypasses extend—in relation to the rotational direction 61 of the agitator element 21—radially from the inside to the outside contrary to the rotational movement, so that the auxiliary grinding bodies 41, to which a centrifugal acceleration has been imparted inside the interior grinding chamber 9", are catapulted off or sucked off and thus returned to the grinding stock inlet again. As shown in FIGS. 2 and 3, the bypasses 60 overlap the face 33 of the interior stator 24 and are open, starting at the inner wall 44 of the rotor 42, radially inward and downward towards the interior grinding chamber 9", so that some sort of transport blades are being formed in this area by the walls 62 of the bypasses 60 which catapult the auxiliary grinding bodies 41 outwardly before they reach the separator device 34 and return them through a funnel-shaped guide conduit 63, placed in the flow direction 52, back to the transition area between the grinding stock supply chamber 53 and the exterior grinding chamber 9'. This guide conduit 63 is also used to prevent a shortcut flow of the grinding stock from the supply chamber 53 to the separator device 34. The space between the closing plate 56 of the separator device 34 and the rotor bottom 46 may be closed by a ring 64 in order to prevent entry of individual auxiliary grinding bodies into this space. In this case the closing plate 56 may be omitted.

Figure 5:
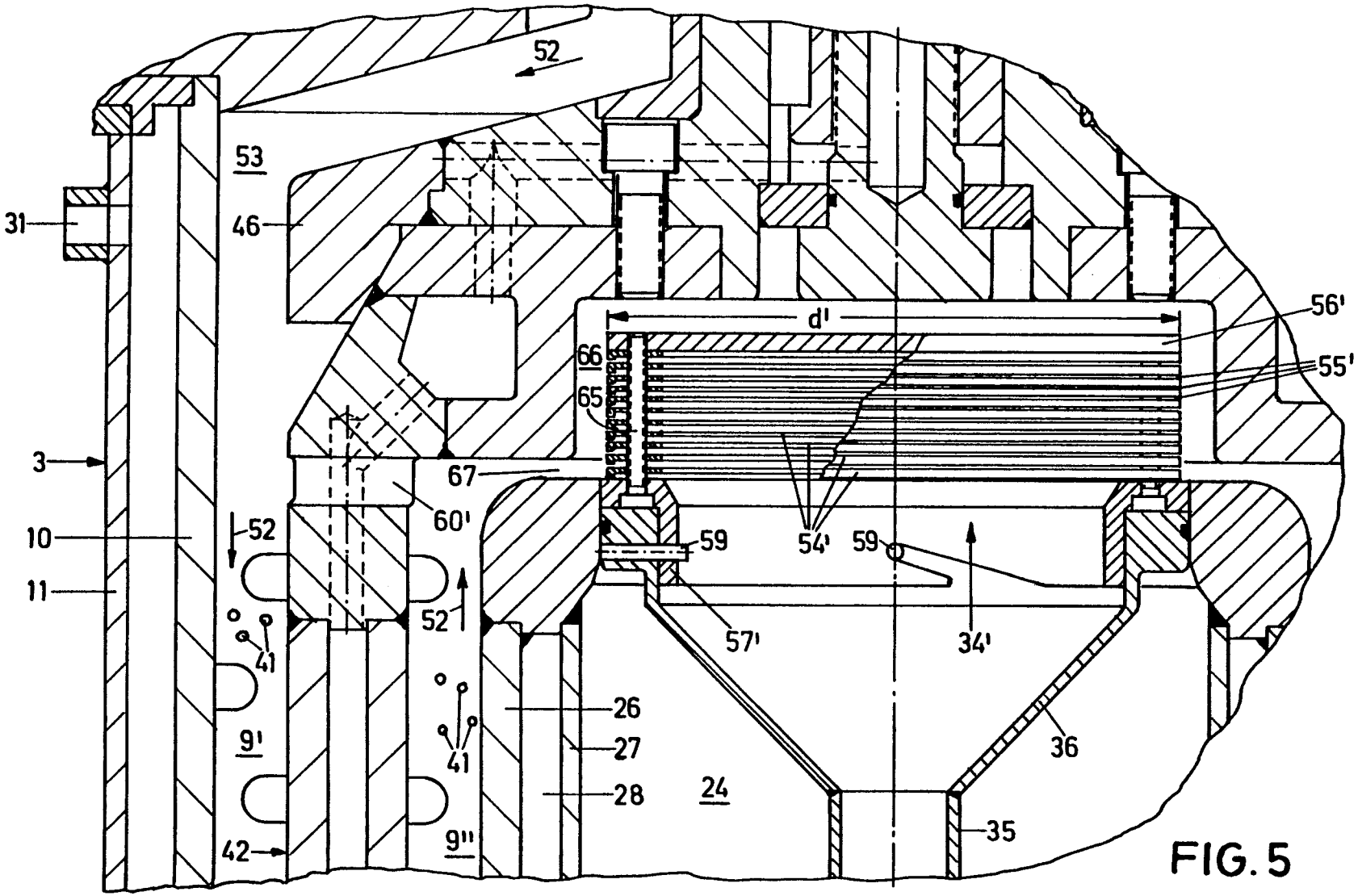

Shown in the changed embodiment according to FIG. 5 is how a closing plate 56', a stack of annular disks 54', defining separating gaps 55' between them, and a support ring 57' are connected with each other by means of screws 65 to form a separator device 34'. In this exemplary embodiment bypasses 60' are placed even further ahead—in relation to the flow direction 52—of the separator device 34'. Here, too, the auxiliary grinding bodies 41 cannot penetrate into the narrow annular cylindrical antechamber 66 between the rotor bottom 46 and the separator device 34 or 34'. In both cases this annular cylindrical antechamber 66 is connected with the interior grinding chamber 9" only by a relatively narrow, annual, radially extending passage 67, through which the auxiliary grinding bodies cannot flow in an inward direction because of the centrifugal force opposing this. The diameter d of the antechamber 66 thus is smaller than the outer diameter D of the interior stator 24. Because the diameter d' of the separator device 34 or 34' is smaller than the diameter d of the antechamber 66 it follows that the diameter d' of the separator device is clearly smaller than the diameter D of the interior stator 24. The exterior diameter d' of the separator device is somewhat narrower than the interior diameter D' of the interior stator 24 so that the pulling out of the separator device, already described, is possible.

As shown in FIG. 5, no agitator implements 50 are attached to the interior stator 24 in the area ahead of the bypasses 60' in order to prevent a slowing down of the auxiliary grinding bodies 41 in this area.

The said agitator implements 50 may be peg-shaped as in the drawings or designed disk-shaped or in any other suitable shape. They also may only be helically extending beads as shown and described in German Patent No. 24 58 841 (corresponding to U.S. Pat. No. 4,059,232).

We claim:

1. An agitator mill for the treatment of flowable grinding stock comprising a grinding receptacle (3) defining a mostly closed grinding chamber (9), an agitator element (21), capable of being rotatingly driven and being cup-shaped in relation to a common central-longitudinal axis (20), disposed in said receptacle, inside of which is disposed an interior stator (24) fixedly connected with the grinding receptacle (3), an exterior grinding chamber (9') being formed between the grinding receptacle (3) and an outer wall (43) of the agitator element (21) and an interior grinding chamber (9'') being formed between an inner wall (44) of the agitator element (21) and the interior stator (24), said interior grinding chamber being disposed coaxially within the exterior grinding chamber (9') and connected with it via a deflection chamber (49), the exterior grinding chamber (9'), the deflection chamber (49) and the interior grinding chamber (9'') forming the grinding chamber (9) which is partially filled with auxiliary grinding bodies (41), a grinding stock supply chamber (53), disposed ahead of the grinding chamber (9) in relation to the flow direction of the grinding stock, a separator device (34, 34') for the discharge of the grinding stock, disposed after the grinding chamber in relation to the flow direction of the grinding stock, said supply chamber and said separator device being disposed on the same side of the grinding receptacle, and bypasses (60, 60') for the return of the auxiliary grinding bodies (41) from the separator device (34, 34') to an area adjacent the grinding stock supply chamber (53) by utilizing centrifugal force being provided by the agitator element, wherein the exterior grinding chamber (9') and the interior grinding chamber (9'') are essentially annular cylindrical, in that the grinding stock supply chamber (53) is placed upstream of the exterior grinding chamber (9') in relation to the flow direction of the grinding stock and the separator device (34, 34') is placed after the interior grinding chamber in relation to the flow direction of the grinding stock and in that the bypasses (60, 60') are placed upstream of the separator device (34, 34') in relation to the flow direction of the grinding stock.

2. An agitator mill in accordance with claim 1, characterized in that the separator device (34, 34') is disposed at a face (33) of the interior stator (24) and is at least partially surrounded by the agitator element (21) forming an annular cylindrical antechamber (66).

3. An agitator mill in accordance with claim 2, characterized in that the diameter (d) of the antechamber (66) is less than the exterior diameter (D) of the interior stator (24).

4. An agitator mill in accordance with claim 3, characterized in that the interior grinding chamber (9'') is connected with the antechamber (66) via a radially extending passage (67).

5. An agitator mill in accordance with claim 4, characterized in that the bypasses (60) are also open in the direction of the passage (67).

6. An agitator mill in accordance with claim 2, characterized in that the diameter (d') of the separator device (34, 34') is less that the interior diameter (D') of the interior stator (24) and the separator device (34. 34') is designed to be removed from the agitator mill through the interior stator (24).

7. An agitator mill in accordance with claim 1, characterized in that the bypasses (60, 60') are generally disposed in a plane perpendicular to the line defined by the central-longitudinal axis (20).

8. An agitator mill in accordance with claim 1, characterized in that the bypasses (60, 60') extend, seen from the direction of the central-longitudinal axis (20), inclined against the rotational direction (61) of the agitator element (21).

9. An agitator mill in accordance with claim 1, characterized in that the bypasses (60, 60') empty into a transition area between the grinding stock supply chamber (53) and the exterior grinding chamber (9') approximately parallel to the flow direction (52) of the grinding stock.

10. An agitator mill in accordance with claim 1, characterized in that transport devices (51) for the auxiliary grinding bodies (41) are provided at a beginning of the interior grinding chamber (9'').

11. An agitator mill in accordance with claim 1, characterized in that agitator implements (50), extending into the grinding chamber (9) are provided at least on the agitator element (21).

12. An agitator mill in accordance with claim 11, characterized in that the interior stator (24) is provided with agitation implements (50) extending into interior grinding chamber (9 41 ), said agitation implements (50) being spaced on said stator (24) above said deflection chamber (49) to a distance below bottom surfaces of said bypasses (60), said distance being sufficient to maintain acceleration of said auxiliary grinding bodies through said bypasses (60).

* * * * *